US006622601B2

(12) United States Patent
Hashimoto et al.

(10) Patent No.: US 6,622,601 B2
(45) Date of Patent: Sep. 23, 2003

(54) PUNCH UNIT FOR PUNCHING A HOLE IN A SOFT METAL SHEET

(75) Inventors: Hidekazu Hashimoto, Shimane (JP); Junichi Nakao, Tottori (JP); Kazuoki Komiyama, Kanagawa (JP)

(73) Assignees: Hitachi Metals Ltd., Tokyo (JP); Hmy, Ltd., Shimane (JP); Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/769,284

(22) Filed: Jan. 26, 2001

(65) Prior Publication Data

US 2001/0020409 A1 Sep. 13, 2001

(30) Foreign Application Priority Data

Jan. 26, 2000 (JP) ..... 2000-016867

(51) Int. Cl.[7] ..... B26D 7/18

(52) U.S. Cl. ..... 83/146; 83/168; 83/68.6

(58) Field of Search ..... 83/684, 686, 692, 83/693, 683, 824, 698.31, 698.91, 563, 130, 168, 129–146

(56) References Cited

U.S. PATENT DOCUMENTS

| | | | | |
|---|---|---|---|---|
| 155,347 | A | | 9/1874 | Tucker |
| 211,619 | A | | 1/1879 | Campbell |
| 374,464 | A | | 12/1887 | Farrin |
| 706,279 | A | | 8/1902 | Temple |
| 1,384,696 | A | | 7/1921 | Gray |
| 1,431,641 | A | | 10/1922 | Erickson |
| 1,594,155 | A | | 7/1926 | Dunfey |
| 1,665,805 | A | | 4/1928 | Walter |
| 2,431,567 | A | * | 11/1947 | Kopczynski et al. ..... 83/146 |
| 2,708,970 | A | | 5/1955 | Taylor |
| 2,882,971 | A | | 4/1959 | Bennett et al. |
| 3,170,349 | A | | 2/1965 | Weinkle |
| 3,465,634 | A | | 9/1969 | Blais |
| 3,469,481 | A | | 9/1969 | Cloup |
| 3,779,113 | A | | 12/1973 | Jestin |
| 4,007,653 | A | * | 2/1977 | Cady ..... 83/684 |
| 4,166,403 | A | * | 9/1979 | DiDonante, Jr. et al. ..... 83/146 |
| 4,240,314 | A | * | 12/1980 | Teeslink ..... 83/635 |
| 4,257,292 | A | * | 3/1981 | Faull ..... 83/146 |
| 4,696,211 | A | * | 9/1987 | Bitzel ..... 83/49 |
| 5,025,691 | A | | 6/1991 | Deni |
| 5,056,392 | A | * | 10/1991 | Johnson et al. ..... 83/140 |
| 5,176,057 | A | * | 1/1993 | Chun et al. ..... 83/139 |
| 5,214,991 | A | * | 6/1993 | Shimizu et al. ..... 83/168 |
| 5,259,225 | A | * | 11/1993 | Koch ..... 72/43 |
| 5,438,897 | A | * | 8/1995 | Chun ..... 83/146 |
| 5,444,908 | A | * | 8/1995 | Kazino ..... 83/146 |
| 5,632,188 | A | | 5/1997 | Karlis |
| 5,697,278 | A | | 12/1997 | Shun-Yi |
| 5,752,424 | A | * | 5/1998 | Rosene et al. ..... 83/686 |
| 5,839,341 | A | * | 11/1998 | Johnson et al. ..... 83/686 |
| 5,871,788 | A | | 2/1999 | Foldesi et al. |
| 5,943,934 | A | * | 8/1999 | Codatto ..... 83/684 |
| 6,152,005 | A | * | 11/2000 | Ootsuka ..... 83/684 |
| 6,367,362 | B1 | | 4/2002 | Brazell et al. |

FOREIGN PATENT DOCUMENTS

| | | |
|---|---|---|
| JP | 11-188429 | 7/1999 |

* cited by examiner

*Primary Examiner*—Kenneth E. Peterson
*Assistant Examiner*—Omar Flores-Sańchez

(57) ABSTRACT

A punch unit (1) having a punch (2) that is reciprocally driven in a punching operation; and, a die (3) cooperating with the punch (2) in punching a punch hole in a soft metal sheet. A cleaning means scrapes a soft metal sheet's fragment, when the fragment is stuck to the punch (2), off of the punch (2). The cleaning means scrapes the fragment by reciprocally moving the punch (2) Further provided in the unit (1) is a punch drive and control circuit (25). The circuit (25) enables the punch to be (2) to perform lost motion at predetermined time intervals. Lost motion enables the punch (2) to scrape the fragment of the soft metal sheet off a surface of the punch (2). Consequently, the fragment of the soft metal sheet does not remain stuck to the punch (2) in the punching operation.

12 Claims, 5 Drawing Sheets

FIG.9
FIG.9A
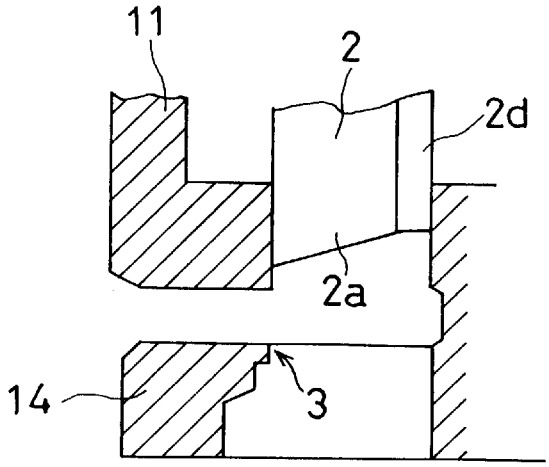
FIG.9B
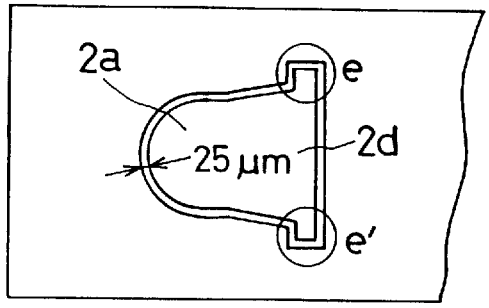
FIG.10
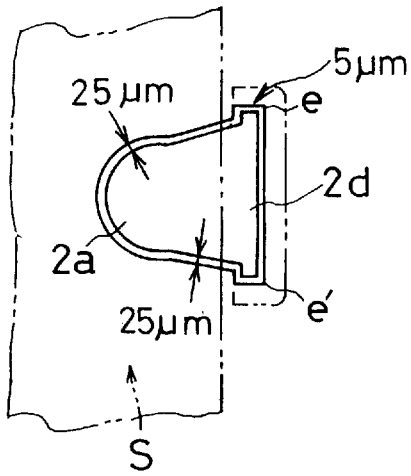

PUNCH UNIT FOR PUNCHING A HOLE IN A SOFT METAL SHEET

BACKGROUND OF THE INVENTION

1. Field of the Invention

The present invention relates to a punch unit for punching a hole (hereinafter referred to as "punch hole") in a soft metal sheet such as an aluminum sheet and the like (hereinafter also referred to as "workpiece"), wherein the punch hole assumes a circular shape or any other suitable shape, and the soft metal sheet having been punched is used in preparing a printing plate in the field of printing plate making.

2. Description of the Related Art

Heretofore, in order to punch a soft metal sheet such as an aluminum sheet and the like used in preparing a printing plate in the field of lithographic printing plate making, a punch unit of a reciprocating type has been used as is in the case where a piece of paper is punched as a workpiece.

However, in case that the soft metal sheet such as the aluminum sheet and the like is punched by using a conventional punch unit heretofore having been used in punching a piece of paper, a fragment of the soft metal sheet tends to stick to a peripheral surface of the punch when the soft metal sheet is punched. In the case where the fragment of the soft metal sheet is accumulated on the peripheral surface of the punch to fill up a radial clearance between the punch and the corresponding die, a frictional drag of the punch drastically increases to make it difficult for the punch unit to continue the punching operation of the soft metal sheet. Eventually, the punch unit fails to perform the punching operation.

Further, since the soft metal sheet tends to stick to the punch when punched, the thus formed punch hole of the soft metal sheet is poor in quality. This is a problem inherent in the conventional punch unit.

SUMMARY OF THE INVENTION

Consequently, it is an object of the present invention to solve the above problem by providing a punch unit for punching a precise high-quality punch hole in a soft metal sheet in a steady manner.

In accordance with a first aspect of the present invention, the above object of the present invention is accomplished by providing:

In a punch unit of a reciprocating type provided with a punch and a die both adapted to punch a punch hole in a soft metal sheet in a punching operation, wherein the punch is slidably guided by a punch guide and reciprocally driven in a condition in which the die cooperates with the punch in the punching operation, the improvement wherein: a cleaning means for removing a fragment of the soft metal sheet from the punch in the punching operation is provided, wherein the fragment has been stuck to the punch in the punching operation; and, removal of the fragment of the soft metal sheet from the punch is carried out by reciprocally driving the punch.

In the conventional punch unit described above, the soft metal sheet (workpiece) tends to stick to the punch. Consequently, in the punch unit of the present invention, there is provided the cleaning means. The cleaning means performs a cleaning operation in which the cleaning means aggressively removes or scrapes the fragment of the soft metal sheet from the punch when the punch is reciprocally driven in the punching operation.

Preferably, the cleaning means is constructed of a punch drive and control means. The punch drive and control means realizes a cleaning or scraping operation in which the fragment of the soft metal sheet is scraped from the punch when the punch performs its lost motion a predetermined times after a predetermined pieces of the punch holes have been formed in the soft metal sheet.

As described above, the punch is driven and controlled by the punch drive and control means to perform the lost motion at predetermined time intervals in the punching operation, so that the soft metal sheet's fragment having stuck to the punch is scraped off the punch. For example, it is possible for the punch unit of the present invention to perform the cleaning operation of the punch in a manner such that the punch performs its lost motion three times after completion of every 10 times of punching operations of the soft metal sheet. It is also possible for the punch unit of the present invention to have the punch perform its lost motion several times a day.

Further, in the punch unit of the present invention, preferably: a gate is located in the side of the die so as to be adjacent to the punch guide; and, the cleaning means is constructed of the gate, wherein, when the punch is reciprocally driven in the punching operation, the gate permits the punch to pass through the gate and thereby scraping the fragment of the soft metal sheet off the punch to serve as the cleaning means.

In the punch unit of the present invention having the above construction, the gate forms a cutting edge for scraping the fragment of the soft metal sheet off the punch. More specifically, when the punch passes through the gate, the cutting edge of the gate scrapes the fragment of the soft metal sheet off the punch. Due to this, in the punch unit of the present invention, there is no fear that the fragment of the soft metal sheet is accumulated on the peripheral surface of the punch. Consequently, there is no fear that a frictional drag of the punch increases in the punching operation of the soft metal sheet. The gate cooperates with the punch drive and control means to remarkably improve the punch unit of the present invention in effect in the cleaning operation.

Incidentally, any other cleaning means may be realized by combining the above cleaning means with any one of a cleaning blade, a mechanical grinding unit, a gas-blower unit and the like. It is also possible to use a single cleaning means in place of combination of a plurality of cleaning means.

Further, in the punch unit of the present invention, preferably: the gate is located in the side of die so as to be adjacent to the punch guide; and, a sheet hold-down means for holding down the soft metal sheet when the punch is retracted from the soft metal sheet after completion of the punching operation is constructed of the gate. The sheet hold-down means, that is, the gate functions to prevent the soft metal sheet from being lifted together with the punch when the punch is retracted after completion of the punching operation. The gate also functions to prevent the soft metal sheet from entering the punch guide (bore). When the soft metal sheet enters the punch guide, the soft metal sheet is completely deformed. Consequently, the punch unit of the present invention is capable of preventing such deformation from occurring in the soft metal sheet.

Further, in the punch unit of the present invention, preferably: the punch guide is divided into an upper guide and a lower guide; the upper guide functions to guide the punch in its drive side; and, the lower guide functions to guide the punch in the side of the die. As a result, it is possible for the punch unit of the present invention to support opposite end portions of the punch. This effectively stabilizes the punch in its sliding motion during the punching operation, and makes it possible to reduce the length of the shaft portion of the punch, and therefore makes it possible to reduce the length of the punch guide. This leads to reduction in frictional drag of the punch, and also leads to reduction in weight of the punch unit.

Preferably, the punch unit of the present invention is further provided with a self-lubricating mechanism for applying a lubricant to the punch. The self-lubricating mechanism is preferably provided in a die block of the punch unit, which may reduce a necessary power for driving the punch and improve each of the punch and the die of the punch unit in service life. Further, the self-lubricating mechanism may be constructed of a felt member in an easy manner. The felt member has been impregnated with a suitable lubricant such as a lubricating oil and the like, and is preferably provided between the upper guide and the lower guide in a condition in which the felt member is brought into contact with the shaft portion of the punch.

Further, preferably, an opening end portion of the punch guide is disposed in the side of a workpiece passage, and punch guide does not interfere (contact) with punch's interference area brought into contact with said soft metal sheet.

In other words, the above arrangement of the punch unit of the present invention prevents the punch having stuck to the soft metal sheet from interfering with the punch guide. Consequently, even when the fragment of the soft metal sheet sticks to the punch in the punching operation, in the punch unit of the present invention, there is no fear that a frictional drag of the punch increases.

Further, in the punch unit of the present invention, the punch is preferably coated with a suitable anti-adhesion agent. This makes it possible to further reduce the frictional drag of the punch, and also makes it possible to prevent the soft metal sheet from sticking to the punch in the punching operation.

Further, in the punch unit of the present invention, preferably, the grooves for reducing a peripheral sliding contact surface area of punch and punch guide is formed at least one of the punch and punch guide. The grooves may be constructed of an annular groove formed in an outer peripheral surface of the punch. It is also possible for the grooves to assumes a plurality of longitudinal grooves which are formed in the outer peripheral surface of the punch and/or in an inner peripheral surface of the punch guide.

Still further, preferably, a thickness of the die is set at a value of from 0.5 to 1.2 mm to reduce the amount of its interference area with respect to the punch in the punching operation, which may effectively reduce the frictional drag of the punch slidably driven in the punch guide during the punching operation. In general, the more the thickness of the die is reduced, the more the fragment of the soft metal sheet having been punched by the punch becomes hard to stick to the punch. On the other hand, the more the thickness of the die is reduced, the more the cutting edge portion of the die is also reduced in mechanical strength. Experiments show that: the die is poor in mechanical strength when used together with its cutting edge portion having a thickness of less than or equal to 0.5 mm; and, the fragment of the soft metal sheet having been punched by the punch tends to stick to the punch when the cutting edge portion of the die has a thickness of more than or equal to 1.2 mm. In order to improve the cutting edge portion of the die in mechanical strength, it is preferable to form the cutting edge portion or bore of the die into a stepped shape. More specifically, it is preferable to provide both a land portion and an undercut angle portion in the bore of the die.

In case that the punch hole of the soft metal sheet does not assume a notch-like shape but assumes a circular shape, a square shape or any other suitable closed-edge shape in opening, it is preferable for the punch to assume a stepped shape constructed of: a shaft portion; and, a cutting edge portion which is differs from the shaft portion in diameter. Such stepped shape enables the punch to be precisely aligned in center line with the punch guide, and also enables the punch to set a radial clearance between the punch and the die at an appropriate value.

In case that the punch unit of the present invention for punching the notch-like shape in the soft metal sheet is characterized in that a deviation prevention means for preventing the punch from deviating from its correct center line in the notch punching operation is constructed of: a cutting edge portion of the punch, wherein the cutting edge portion covers the entire cut portion of the notch, wherein a radial clearance between the punch and a bore of the die has a predetermined value; and, the shaft portion of the punch, which shaft portion is precisely and slidably guided by the punch guide in the notch punching operation.

The punch for punching a notch in the edge portion of the soft metal sheet differs in shape from an ordinary punch for punching an ordinary punch hole or closed-edge hole. Due to this, in case that the notch punching operation is performed, it is necessary to form the ordinary punch into a stepped shape. However, such shaping operation of the punch is very expensive. When the ordinary punch used in punching the punch hole is used to punch a notch in the edge portion of the soft metal sheet without shaping the punch into the stepped shape, the punch tends to deviate from its correct center line, which makes it difficult to keep the radial clearance between the punch and the die at the appropriate value. As a result, the fragment of the soft metal sheet having been punched by the punch tends to stick to the punch. In order to solve this problem, in the punch unit of the present invention, the punch's shaft portion (i.e., guide portion) is not brought into contact with the notch thus formed in the edge portion of the soft metal sheet, and is slidably supported by the die during the notch punching operation to prevent the punch from deviating from its correct center line, which enables the punch to be precisely guided during the notch punching operation. Due to the above arrangement, it is possible for the punch unit of the present invention to keep the radial clearance between the punch and the die at an appropriate value even in the notch punching operation. This enables the punch used in the punch unit of the present invention to punch a notch in the edge portion of the soft metal sheet in a steady manner, and prevents the fragment of the soft metal sheet thus punched from sticking to the punch.

The punch unit of the present invention is most effectively used in the case where the soft metal sheet is an aluminum sheet or an aluminum-alloy sheet. However, it is also possible to use the punch unit of the present invention in punching any other soft metal sheet such as a copper sheet, a copper-alloy sheet, a lead-alloy sheet and the like.

Also, The punch unit of the present invention is effectively the punching in the soft metal sheet is used in the field of printing plate making.

As described above, in the punch unit of the present invention having the above construction, it is possible to punch a high quality punch hole in the soft metal sheet, and also possible to improve both the punch and the die in service life. This makes it possible to improve the punch unit of the present invention in accuracy and in efficiency in punching an aluminum sheet and like workpiece when a printing plate used in the lithographic printing operation is prepared.

BRIEF DESCRIPTION OF THE DRAWINGS

The above and other objects, advantages and features of the present invention will be more apparent from the following description taken in conjunction with the accompanying drawings in which:

FIG. 9A is a partially sectional front view of the punch unit shown in FIG. 1, illustrating the notch punching operation performed by using a modified one of the punch;

FIG. 9B is a plan view of the die of the punch unit shown in FIG. 1, illustrating the radial clearance between the punch and the die; and FIG. 10 is a plan view of the soft metal sheet (workpiece) to be punched by the punch unit show in FIG. 1 to form a notch in the edge portion of the soft metal sheet, illustrating the relationship between the punch and the edge portion of the soft metal sheet.

DETAILED DESCRIPTION OF THE PREFERRED EMBODIMENTS

Figure 1:
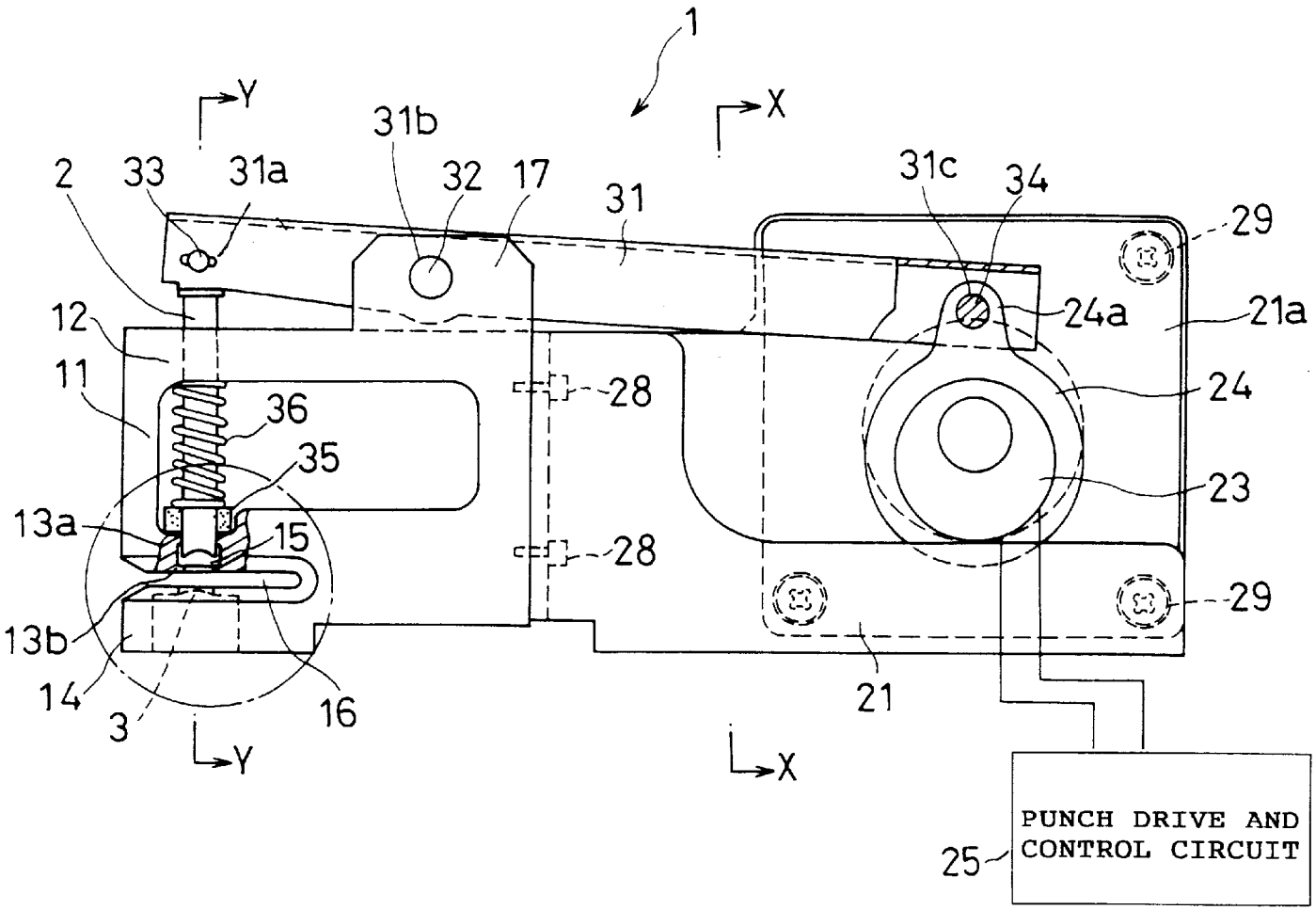
FIG. 1 is a front view of an embodiment of the punch unit of the present invention for punching a punch hole in the soft metal sheet.

The best modes for carrying out the present invention will be described in detail using embodiments of the present invention with reference to the accompanying drawings.

The present invention may, however, be embodied in various different forms and should not be construed as limited to the embodiments set forth herein; rather, these embodiments are provided so that this disclosure will be thorough and complete, and will fully convey the scope of the present invention to those skilled in the art.

In the accompanying drawings, like reference numerals/letters refer to like parts throughout the drawings.

FIRST EMBODIMENT

A first embodiment of a punch unit 1 of the present invention for punching a punch hole in a soft metal sheet constituting a workpiece will be described with reference to the drawings.

With reference to FIG. 1, a main frame of the punch unit 1 will be first described in construction. As shown in FIG. 1, the punch unit 1 is constructed of: a punch block 11 which is integrally formed with an upper punch guide 12, a lower punch guide 13*a* and a die block 14; and, a motor bracket 21 on which a motor 22, a drive portion 23 and like components are mounted. As is clear from FIG. 1, the motor bracket 21 is fixedly mounted on the punch block 11 by using of a plurality of screws 28 to form the main frame of the punch unit 1.

The punch block 11 assumes a substantially hollow square shape, and is provided with a horizontal workpiece passage 16 in a left corner portion of its lower section, as viewed in FIG. 1. As is clear from FIG. 1, the horizontal workpiece passage 16 has a workpiece-receiving opening formed in its left end portion. Preferably, the workpiece-receiving opening of the workpiece passage 16 is chamfered in a manner shown in FIG. 1 to facilitate entrance of the workpiece (i.e., soft metal sheet) "s" to the workpiece passage 16.

The upper punch guide 12 and the lower punch guide 13*a* represent an upper guide bore and a lower guide bore, respectively. Consequently, hereinafter, the upper guide bore and the lower guide bore will be referred to as the guide bores 12 and 13*a,* respectively. These guide bores 12, 13*a* are formed as through-holes passing through the punch block 11 in a manner such that the guide bores 12, 13*a* extend in a direction perpendicular to a plane in which the workpiece or soft metal sheet extends. As is clear from FIG. 1, the lower guide bore 13*a* is disposed adjacent to an upper portion of the workpiece passage 16. On the other hand, the upper guide bore 12 is disposed above and spaced apart from the lower guide bore 13*a* in the punch block 11, so that the guide bores 12, 13*a* function to slidably receive therein and guide the punch 2 in the punching operation thereof.

In the vicinity of the workpiece passage 16, there is provided a through-hole window 15. The window 15 extends in a direction perpendicular to a longitudinal axis of the lower guide bore 13*a*. In other words, an upper portion of the window 15 forms the lower guide bore 13*a*. On the other hand, a lower portion of the window 15 is disposed adjacent to the workpiece passage 16 to form a gate 13*b*. The gate 13*b* has a bore diameter which is slightly larger or substantially equal to a diameter of a cutting edge portion 2*a* of the punch 2. Due to the presence of the gate 13*b,* it is possible for the punch unit 1 to remove therefrom any fragment of the workpiece having stucked to the punch 2 by using an edge portion of the gate 13*b* when the punch is moved up and down in the punching operation of the workpiece. The thus removed fragment of the workpiece is then discharged out of the punch unit 1 through both the workpiece passage 16 and the through-hole window 15, so that frictional drag of the punch 2 due to the presence of the fragment stuck thereto is remarkably reduced in the punch unit 1. Incidentally, since the gate 13*b* serves as a cleaning blade, it is possible for the gate 13*b* to have its wall thickness reduced.

In the punch unit 1 having the above construction, the punch 2 has its upper and its lower portion slidably received in the upper guide bore 12 and the lower guide bore 13*a,* respectively. Consequently, it is possible for the punch unit 1 to move the punch 2 up and down with high accuracy in the punching operation with respect to a radial clearance between the punch 2 and the die 3, which ensures that the punch unit 1 punches or forms a high-quality punch hole in the workpiece (i.e., soft metal sheet).

As shown in FIG. 1, a bearing unit 17 is provided in an upper section of the punch block 11 to pivotally support a swing arm 31 through a pivot 32 therein.

The die block 14 is integrally formed with a lower portion of the workpiece passage 16 to form the die 3.

In contrast with this, in a conventional punch unit for punching a punch hole in a piece of paper and the like, in general, its punch guides and its die block are formed into different components. Such different components are then assembled together to serves as a single-piece block in the conventional punch unit.

As shown in FIG. 1, a felt member 35 is mounted in an opening portion of the punch block 11 to serve as a self-lubricating mechanism for applying a lubricant to the punch 2. The felt member 35 is provided with a through-hole, through which through-hole the punch 2 passes and has its outer peripheral surface lubricated with a suitable lubricant or lubricating oil in the punching operation. As is clear from FIG. 1, the felt member 35 is disposed between an inner surface of the punch block 11 and a lower end portion of a compression coil spring 36, and resiliently urged downward by the compression coil spring 36. Since the felt member 35 is impregnated with the lubricating oil, the lubricating oil is automatically transferred from the felt member 35 to the outer peripheral surface of the punch 2, and gradually moves down along the length of the punch 2 to reach its cutting edge portion 2*a,* so that the cutting edge portion 2*a* of the punch 2 is lubricated with the lubricating oil when the punch 2 is moved up and down in the punching operation, whereby the fragment of the soft metal sheet "s" having been punched is more effectively prevented from sticking to the punch 2.

Figure 4:
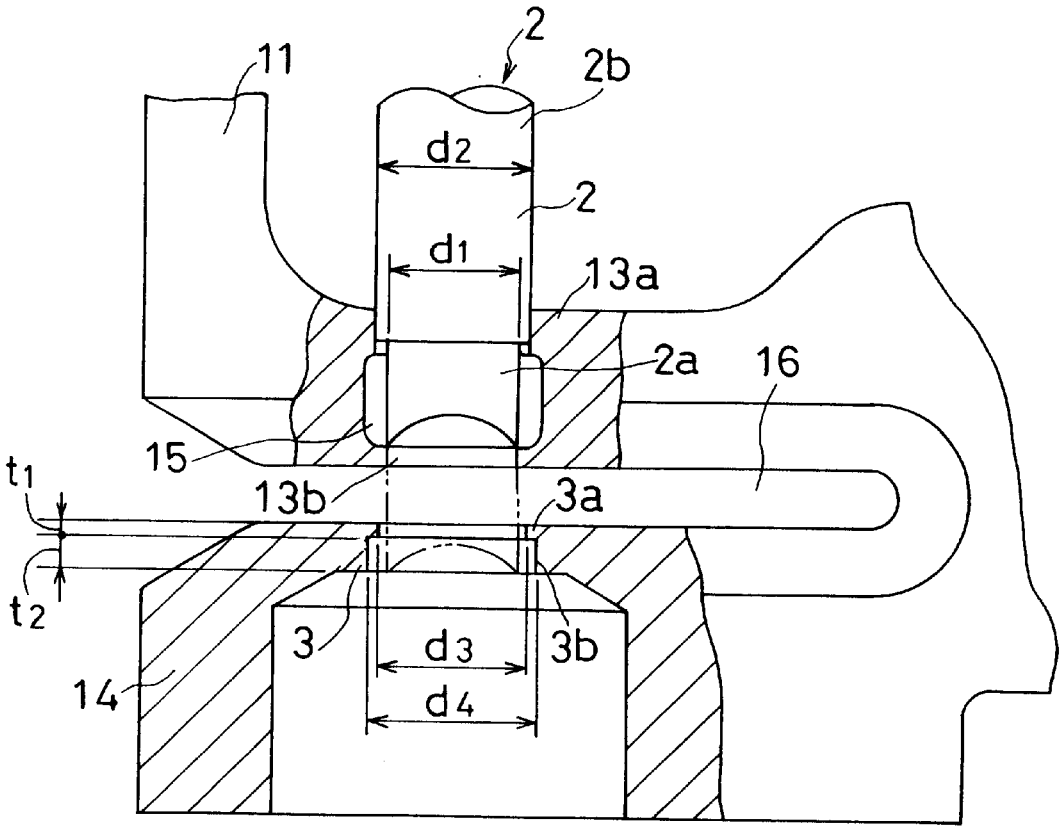
FIG. 4 is a partially enlarged front view of a die block of the punch unit of the present invention shown in FIG. 1.
Figure 5:
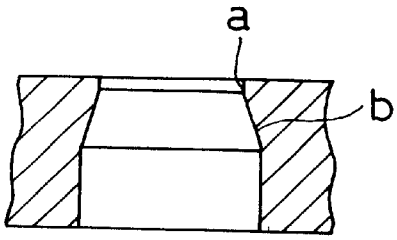
FIG. 5 is a longitudinal sectional view of the die disposed in the die block shown in FIG. 4, illustrating the shape of the bore of the die.

As shown in FIG. 4, the punch 2 assumes a stepped-shape in its lower portion in which: the cutting edge portion 2*a* of the punch 2 has a diameter of "$d_1$"; and, a shaft portion 2*b* of the punch 2 has a diameter of "$d_2$" which is larger than the diameter of the cutting edge portion 2*a* of the punch 2. The shaft portion 2*b* of the punch 2 is slidably received in both the upper punch guide 12 and the lower punch guide 13*a.* As shown in FIG. 4, a through-hole 2*c* is formed in an upper portion of the shaft portion 2*b* of the punch 2 to extend in a direction perpendicular to the longitudinal axis of the punch 2. On the other hand, the swing arm 31 is provided with a pair of elongated holes 31*a* together with a plurality of through-holes 31*b,* 31*c,* and has the elongated holes 31*a* aligned in center with the through-hole 2*c* of the punch 2 to permit a punch pin 33 to pass therethrough, as shown in FIG. 4. Through this punch pin 33, the punch 2 is rotatably connected with a front end portion (i.e., follower end portion) of the swing arm 31.

Due to the above arrangement, it is possible to keep the radial clearance between the punch 2 and the die 3 at an appropriate value in fit tolerance by precisely having the shaft portion 2*b* of the punch 2 slidably fitted in each of the upper punch guide 12 and the lower punch guide 13*a* in an insertion manner.

Figure 7:
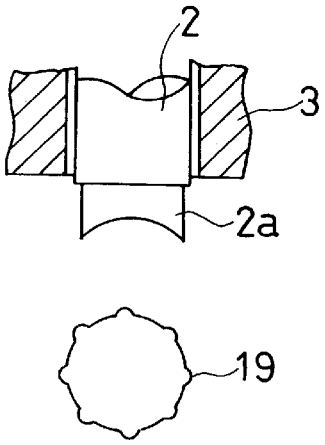
FIG. 7 is a longitudinal sectional view of the lower punch guide of the punch unit shown in FIG. 1, illustrating a plurality of longitudinal grooves formed in the lower punch guide.

Further, as shown in FIGS. 4 and 7, in the punch unit 1, since the cutting edge portion 2*a* of the punch 2 assumes a circularly-curved shape, it is possible for the punch unit 1 to prevent defective notches from being formed in the peripheral portion of the punch hole of the soft metal sheet (workpiece), in which peripheral portion the punch 2 hits the soft metal sheet "s" at the end of the punching operation.

Further, an outer peripheral surface of the cutting edge portion 2*a* of the punch 2 is coated with a suitable anti-adhesion agent, for example such as a diamond-like carbon (i.e., DLC) and the like.

FIG. 4 shows the details of the die block 14, provided in which is the die 3 having a cutting edge portion 3*a.* This cutting edge portion 3*a* is coaxially arranged with the punch guide bores 12, 13*a,* and has a diameter of "$d_3$". Disposed under the cutting edge portion 3*a* of the die 3 is an undercut portion 3*b* having a diameter of "$d_4$" which is larger than the diameter "$d_3$" of the cutting edge portion 3*a* of the die 3. In this punch unit 1, the radial clearance between an outer peripheral surface of the punch 2 and an inner peripheral surface of the bore of the die 3 is set at a value of from 4 to 15% of a thickness of the soft metal sheet (workpiece). In other words, the relationship between the outer diameter "$d_1$" of the cutting edge portion 2*a* of the punch 2 and the inner diameter "$d_3$" of the bore of the die 3 may be defined in the following equation:

$$(d_3-d_1)/2=(T\times\text{a value of from 4 to 15})/100$$

where: T is a thickness of the soft metal sheet (workpiece).

Preferably, the radial clearance between the punch 2 and the die 3 is set at a value of from 6 to 12% of the thickness "T" of the soft metal sheet.

In contrast with this, in the conventional punch unit for punching a punch hole in a piece of paper and the like, such radial clearance between the punch and the die is set at a value of from 5 to 10 $\mu$m. However, when the conventional punch unit is used to punch the soft metal sheet, a secondary shearing action occurs in the punch hole to have a fragment of the soft metal sheet often stick to the punch, which prevents the punch from producing a high-quality punch hole and considerably reduces the service life of each of the punch and the die. In the conventional punch unit, due to the presence of such fragment stuck to the punch, the punch suffers from a considerable frictional drag during the punching operation of the soft metal sheet, which often stops the operation of the punch. However, it is possible to solve this problem of the frictional drag of the punch by using the punch unit 1 of the present invention.

In the punch unit 1 of the present invention, a thickness of the cutting edge portion 3*a* of the die 3 is represented by the reference letter and numeral "$t_1$". Although the thickness "$t_1$", of the cutting edge portion 3*a* of the die 3 is preferably set at the smallest possible value in order to reduce its interference area (i.e., frictional contact area) with the punch 2, it is necessary for the cutting edge portion 3*a* of the die 3 to withstand a punching load imposed thereon during the punching operation. Due to this necessity, the punch unit 1 of the present invention uses a value of from 0.5 to 1.2 mm as the thickness of the cutting edge portion 3*a* of the die 3. The diameter "$d_3$" of the undercut portion 3*b* disposed under the lower portion of the cutting edge portion 3*a* of the die 3 is set at a value slightly larger than the inner diameter "$d_1$" of the bore of the die 3 to permit a chad (i.e., a small metal piece formed when the punch hole is punched in the soft metal sheet) to freely drop out of the undercut portion 3*b.*

Figure 6:
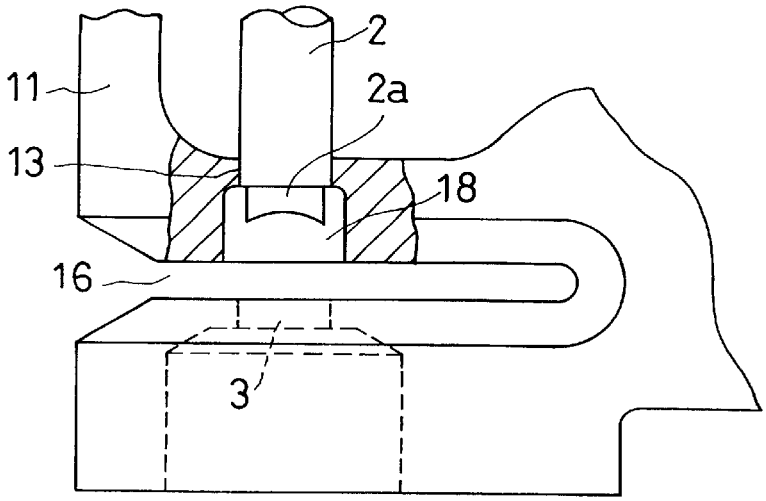
FIG. 6 is a partially enlarged longitudinal sectional view of the lower punch guide, illustrating a concave portion provided in the lowermost surface of a lower punch guide.

In the first embodiment, though the die 3 has a two-stepped bore shape, it is also possible for the die 3 to assume any other shape, for example such as one shown in FIG. 6, in which one: a land portion "a" and an undercut angle portion "b" are provided.

On the other hand, the motor bracket 21 is formed of a metal plate, and assumes a U-shaped form. The motor bracket 21 and the punch block 11 are assembled together using a plurality of screws 28. The motor bracket 21 is provided with an end plate portion 21*a* on which the motor 22 is fixedly mounted using four pieces of screws 29.

An eccentric cam 23 is fixedly mounted on a rotating shaft of a motor 22. On the other hand, a link 24 is rotatably mounted on an outer peripheral surface of the eccentric cam 23, but prevented from axially moving relative to the eccentric cam 23. The link 24 is provided with a link opening 24*a.*

The link opening 24*a* is aligned in center with the through-holes 31*c* of a drive end portion of the swing arm 31 to permit a link pin 34 to pass therethrough, so that the link 24 is rotatably engaged with the swing arm 31 through the link pin 34.

Figure 2:
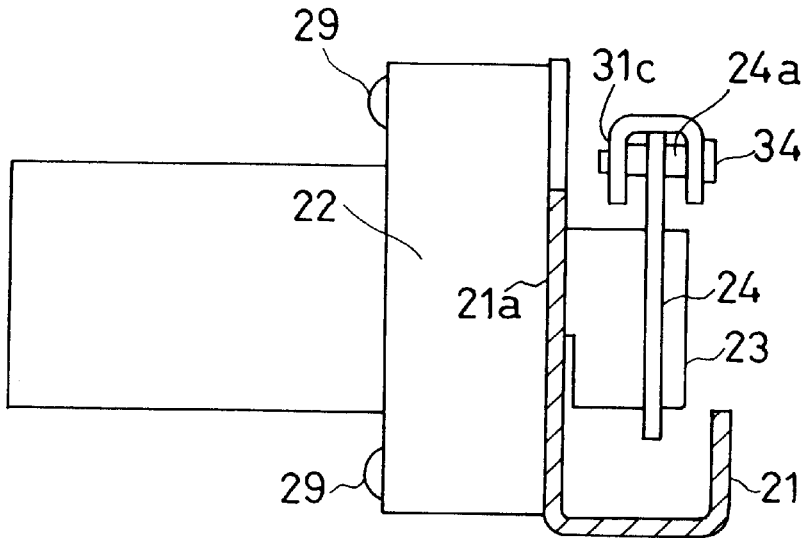
FIG. 2 is a cross-sectional view of an essential part of the punch unit of the present invention, taken along the line of X—X of FIG. 1.
Figure 3:
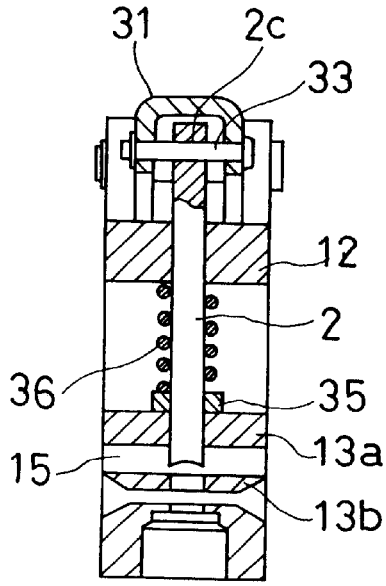
FIG. 3 is a cross-sectional view of another essential part of the punch unit of the present invention, taken along the line of Y—Y of FIG. 1.

As shown in FIG. 2, the swing arm 31 assumes a channel-like shape in cross section, and has its follower end portion disposed in the side of the punch 2. The swing arm 31 has an intermediate portion of this follower end portion rotatably mounted on the pivot 32. This pivot 32 passes through the bearing unit 17 disposed in the upper portion of the punch block 11. The follower end portion of the swing arm 31 is provided with the elongated holes 31*a* which are aligned in center with the through-hole 2*c* of the punch 2 to rotatably receive therein the punch pin 33 in a manner such that the punch 2 is capable of moving up and down in the punching operation. On the other hand, as described above, the drive end portion of the swing arm 31 is rotatably engaged with the link 24.

The motor 22 is energized and controlled by a motor drive and control means or circuit 25 (shown in FIG. 1). When the eccentric cam 23 is rotatably driven by the motor 22, the swing arm 31 is swingably driven on the pivot 32 by the eccentric cam 23 through the link 24 and the link pin 34. As a result, the punch 2 is reciprocally driven by the swing arm 31 through the elongated holes 31*a* and the punch pin 33 so as to be moved up and down. Due to the above arrangement, it is possible for the punch unit 1 to punch a high-quality punch hole in the workpiece or soft metal sheet having been inserted into the workpiece passage 16 in the punching operation. After completion of such punching operation, a detection means (not shown) detects a predetermined angular position of the eccentric cam 23. According to detection of such predetermined angular position of the eccentric cam 23, the motor 22 stops in operation to have the punch 2 stopped at its upper dead point corresponding to a standby position of the punch 2.

Further, the punch drive and control circuit 25 is also capable of energizing the motor 22 in a manner such that the motor 22 permits the punch 2 to perform its lost motion at predetermined time intervals. For example, after completion of every 10 times of punching operations of the workpiece or soft metal sheet, the punch 2 performs its lost motion three times to remove the fragment of the soft metal sheet having stuck to the punch 2 by using the upper and the lower edge of the gate 13*b*, which enables the punch 2 to perform its cleaning operation. Alternatively, it is also possible for the punch unit 1 to permit an operator to turn on a switch (not shown) at the beginning of the punching operation or to turn off the switch (not shown) at the end of the punching operation, so that the punch 2 performs its automatic lost motion to clean itself.

In the above embodiments, though the punch hole of the soft metal sheet assumes a circular shape, it is also possible for the punch hole to assume any other shape, for example such as a square shape, a rectangular shape, an oval shape, an elongated round shape, a keyhole-like shape and the like. It is also possible to use the punch unit 1 in punching a notch in an edge portion of the soft metal sheet.

When the punch 2 is used to punch a notch in the edge portion of the soft metal sheet, the punch 2 is modified in shape as shown in FIGS. 9A and 9B. More specifically, FIG. 9A illustrates the punching operation performed by using a modified one of the punch 2, and FIG. 9B shows a plan view of the die 3, illustrating the radial clearance between the punch 2 thus modified and the die 3. Incidentally, FIG. 10 shows a plan view of the soft metal sheet (workpiece) to be punched by the modified punch 2 to form the notch in the edge portion of the sheet, illustrating the relationship between the modified punch 2 and the soft metal sheet.

As is clear from FIG. 10, the punch 2 assumes a keyhole-like shape in cross section. The keyhole-like shape comprises: a portion corresponding to the cutting edge portion 2*a* of the punch 2; and, a guide portion 2*d* for preventing the cutting portion 2*a* from deviating from its correct center line when the punch 2 punches a notch in the edge portion of the soft metal sheet.

Further, with respect to this keyhole-like shape, the portion corresponding to the cutting edge portion 2*a* of the punch 2 is laterally spaced apart from the corresponding cutting edge portion 3*a* of the die 3 through the radial clearance having been set at an appropriate value.

On the other hand, as is clear from FIGS. 9A, 9B and 10, the guide portion 2*d* of the punch 2 is slidably supported by the die block 14 at a pair of positions "e" and "e'" in cross section in a stable manner, so that the punch 2 is prevented from deviating from its correct center line in the notch punching operation.

Due to the provision of the guide portion 2*d* in the punch 2, it is possible to prevent the punch 2 from deviating in position even when the punch 2 is used to punch a notch in the edge portion of the soft metal sheet and therefore subjected to a considerable radial thrust exerted by the edge portion of the soft metal sheet in the notch punching operation. In other words, this ensures that the radial clearance between the punch 2 and the die 3 is kept at an appropriate value in the case shown in FIG. 10, and therefore substantially ensures that the fragment of the soft metal sheet "s" thus punched is prevented from sticking to the punch 2.

In the embodiment of the present invention, the radial clearance between the guide portion 2*d* of the punch 2 and the die 3 is kept at a value of preferably less than or equal to 5 $\mu$m. On the other hand, the notch is punched at a designed point on the soft metal sheet in a condition in which an error in value of the radial clearance between the punch 2 and the die 3 is kept at a value of 25 $\mu$m in average in any position of the peripheral edge of the notch in the edge portion of the soft metal sheet.

EXAMPLE

The punch unit 1 of the present invention for punching a punch hole in a soft metal sheet was used to punch a punch hole having a diameter of 6 mm in each of a first and a second sheet both made of pure aluminum (hereinafter referred to as the first and the second aluminum sheet) having a thickness of 0.2 mm and a thickness of 0.3 mm, respectively. A radial clearance between the punch 2 and the die 3 in the punch unit 1 of the present invention was 15 $\mu$m (which corresponds to 7.5% of the thickness of the first aluminum sheet) when the first aluminum sheet having a thickness of 0.2 mm was punched. On the other hand, when the second aluminum sheet having a thickness of 0.3 mm was punched, such radial clearance was 30 $\mu$m (which corresponds to 10.0% of the thickness of the second aluminum sheet).

In the above embodiment of the present invention, as a cleaning means for cleaning the punch 2 in the punching operation, there is provided the punch drive and control circuit 25, as shown in FIG. 1. The circuit 25 is provided with a cleaning mechanism for instructing the motor 22 to perform its lost motion at predetermined time intervals in order to clean the punch 2. The cleaning means or mechanism of the punch drive and control circuit 25 cooperates with the gate 13*b* in performing a cleaning operation of the punch 2 during the punching operation of the soft metal sheet.

The effects of the cleaning operation performed by the punch drive and control circuit 25 and the gate 13*b* in combination thereof are as follows: namely, when the conventional punch unit for punching a piece of paper and like workpieces is used for punching a punch hole in an aluminum sheet which is one of the soft metal sheets, both a punch and a die of the conventional punch unit are found that they are considerably worn out after 500 pieces of the punch holes are formed in the aluminum sheet. Further, the thus worn-out punch and die of the conventional punch unit are found that they tend to stick to the aluminum sheet, which makes it impossible to continue the punching operation of the conventional punch unit.

In contrast with this, the punch unit 1 of the present invention is found that it is capable of continuing its further punching operation even after 30,000 pieces of the punch holes are formed.

As is clear from the above, it is possible for the punch unit 1 of the present invention to enjoy its remarkable effects on durability and efficiency in the punching operation of the soft metal sheet.

In the punch unit 1, with respect to the cleaning operation of the punch 2, it is also possible to eliminate the need of the gate 13*b* by providing a concave portion 18 in the lowermost surface of the lower punch guide 13*a,* as viewed in FIG. 6. The concave portion 18 thus provided in the lowermost surface of the lower punch guide 13*a* prevents the lowermost surface of the punch guide 13*a* from interfering with the cutting edge portion 2*a* of the punch 2 having punched the soft metal sheet, and therefore prevents the fragment of the soft metal sheet having stuck to the punch 2 from filling up the radial clearance between the punch 2 and the die 3. Since the provision of the concave portion 18 in the lower punch guide 13*a* prevents the fragment of the soft metal sheet from hitting the lower punch guide 13*a,* there is no fear that the frictional drag of the punch 2 increases in the punching operation. The concave portion 18 of the lower punch guide 13*a* may be formed into a circular shape or any other suitable shape such as a notch-like shape or the like in cross section.

Figure 8:
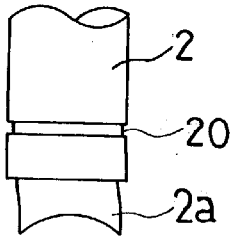
FIG. 8 is a front view of the punch used in the punch unit shown in FIG. 1, illustrating an annular groove formed in the outer peripheral surface of the punch.

Further, it is also possible for the punch unit 1 of the present invention to employ another method for reducing the frictional drag of the punch 2 in the punching operation of the soft metal sheet. More specifically, as shown in FIG. 7, a plurality of longitudinal grooves 19 may be provided in an outer peripheral surface of the punch 2 so as to extend along the length of the punch 2, or in an inner peripheral surface of each of the punch guides 12, 13*a* so as to extend along the length of each of the punch guides 12, 13*a*. Still further, as shown in FIG. 8, it is also possible to provide an annular groove 20 in the outer peripheral surface of the punch 2 to realize the method for reducing the frictional drag of the punch 2 in the punching operation of the soft metal sheet.

As described above, in the punch unit 1 having the above construction, since there is provided the cleaning means (i.e., the punch drive and control circuit 25) for enabling the punch 2 to perform its lost motion in the punching operation, it is possible for the punch unit 1 to scrape or remove the fragment of the soft metal sheet from the punch 2 by reciprocally driving the punch 2 in the punching operation. Further, the provision of the cutting edge portions of the gate 13*b* makes it possible to forcibly scrape the fragment of the soft metal sheet off the punch 2. Consequently, the punch unit 1 is free from a fear that the fragment of the soft metal sheet is accumulated on the punch 2, and therefore free from a fear that the fragment of the soft metal sheet having stuck to the punch 2 gradually increases the frictional drag of the punch 2 to make it hard to perform the punching operation of the soft metal sheet. In other words, the punch unit 1 makes it possible to remarkably improve each of the punch 2 and the die in service life.

Further, in the punch unit 1, the provision of the concave portion 18 in the lowermost surface of the lower punch guide 13*a* makes it possible to prevent the lower punch guide 13*a* from interfering with the punch 2 having punched the soft metal sheet Consequently, there is no fear that the fragment of the soft metal sheet having stuck to the punch 2 is brought into contact with the lower punch guide 13*a*. In other words, there is no fear that the frictional drag of the punch 2 increases in the punching operation even when the fragment of the soft metal sheet has stuck to the punch 2. In the punch unit 1 of the present invention, in order to enhance the cleaning operation of the punch 2 in effect, it is preferable to use the gate 13*b* in addition to the provision of the concave portion 18 in the lower punch guide 13*a* when the cleaning operation of the punch 1 is performed in the punching operation of the soft metal sheet.

Further, when the punch 2 is coated with the anti-adhesion agent, it is possible to effectively prevent the fragment of the soft metal sheet from sticking to the punch 2.

Still further, the provision of the self-lubricating mechanism 35 for applying the lubricant (i.e., lubricating oil) to the punch 2 ensures that the fragment of the soft metal sheet does not stick to the punch 2 in the punching operation.

The provision of at least one of the longitudinal grooves 19 in at least one of: the outer peripheral surface of the punch 2; and, the inner peripheral surface of each of the punch guides 12, 13*a,* may further effectively reduce the frictional drag of the punch 2 in the punching operation. It is also possible to further reduce the frictional drag of the punch 2 by reducing the thickness of the die 3 so as to reduce the dies interference area brought into contact with the punch 2.

Incidentally, the punch unit 1 of the present invention may be most effectively used when the punch unit 1 is used to punch the aluminum sheets, aluminum-alloy sheets and like workpieces.

Finally, the present application claims the Convention Priority based on Japanese Patent application No. 2000-016867 filed on Jan. 26, 2000, which is herein incorporated by reference.

What is claimed is:

1. In a punch unit of a reciprocating type provided with a punch and a die both adapted to punch a punch hole in a soft metal sheet in a punching operation, wherein said punch is slidably guided by a punch guide and reciprocally driven in a condition in which said die cooperates with said punch in said punching operation, the improvement comprising:

a cleaner for removing a fragment of said soft metal sheet from said punch in said punching operation, wherein said fragment has been stuck to said punch in said punching operation;

wherein removal of said fragment of said shaft metal sheet from said punch is carried out by reciprocally driving said punch;

wherein said cleaner includes a punch drive, a gate for scraping said fragment of said soft metal sheet from said punch; and a control circuit;

wherein said control circuit controls said punch drive so that it drives an end of the punch past the gate a predetermined plural number of times after a predetermined number of pieces of said punch holes have been consecutively formed in said soft metal sheet without reciprocally driving the end of the punch past the gate; and wherein the gate is located in said punch guide, and when said punch is reciprocally driven, said gate permits the end of said punch to pass through said gate thereby scraping said fragment of said soft metal sheet off said punch.

2. The punch unit as set forth in claim 1, wherein said cleaner is a gate located in a side of said die adjacent to said punch guide, and further comprising a sheet holder for holding down said soft metal sheet when said punch is retracted from said soft metal sheet after completion of said punching operation.

3. The punch unit as set forth in claim 1, wherein: said punch guide is divided into an upper guide and a lower guide; said upper guide functions to guide said punch in said punch's drive side; and, said lower guide functions to guide said punch in the side of said die.

4. The punch unit as set forth in claim 1, wherein: said punch unit is further provided with a self-lubricating mechanism for applying a lubricant to said punch.

5. The punch unit as set forth in claim 1, wherein an opening end portion of said punch guide, is disposed in the side of a workpiece passage, and punch guide does not interfere with punch's interference area brought into contact with said soft metal sheet.

6. The punch unit as set forth in claim 1, wherein said punch is coated with an anti-adhesion agent.

7. The punch unit as set forth in claim 1, wherein grooves reduce a peripheral sliding contact surface area of said punch and said punch guide, wherein said grooves are formed on at least one of said punch and said punch guide.

8. The punch unit as set forth in claim 1, wherein a thickness of said die is set at a value of from 0.5 to 1.2 mm to reduce the amount of the die's interference area brought into contact with said punch in said punching operation.

9. The punch unit as set forth in claim 1, wherein said punch has a shaft portion and a cutting edge portion, wherein the shaft portion and cutting edge portion differ in diameter from each other.

10. The punch unit as set forth in claim 1, wherein said punch punches a notch in an edge portion of said soft metal sheet in a notch punching operation; wherein a cutting edge portion of said punch prevents said punch from deviating from said punch's correct center line in said notch punching operation wherein said cutting edge portion covers the entire cut portion of said notch, wherein a radial clearance between said punch and a bore of said die has a predetermined value; and, said shaft portion of said punch, wherein said shaft portion is precisely and slidably guided by said punch guide in said notch punching operation.

11. The punch unit as set forth in claim 1, wherein said soft metal sheet is made of aluminum or aluminum alloys.

12. The punch unit as set force in claim 11, wherein said soft metal sheet is used in the field of printing plate making.

* * * * *